United States Patent [19]

MacKendrick et al.

[11] Patent Number: 4,805,802

[45] Date of Patent: Feb. 21, 1989

[54] VALVE FOR PUNCTURING AND RELEASING GAS FROM A PRESSURIZED CYLINDER

[75] Inventors: Robert R. MacKendrick, Milford; John J. McKeon, Hamden, both of Conn.

[73] Assignee: Air-Lock, Incorporated, Milford, Conn.

[21] Appl. No.: 12,868

[22] Filed: Feb. 10, 1987

[51] Int. Cl.[4] ..... B67B 7/64

[52] U.S. Cl. ..... 222/5; 222/83; 441/93

[58] Field of Search ..... 222/3, 5, 80, 81, 83; 441/93, 94, 95

[56] References Cited

U.S. PATENT DOCUMENTS

| | | | |
|---|---|---|---|
| 805,474 | 11/1905 | Lavertine et al. | 222/5 |
| 1,782,020 | 11/1930 | Allen et al. | 222/5 |
| 1,826,088 | 10/1931 | Ostlind | 251/44 |
| 2,028,651 | 1/1936 | Dagnall et al. | 222/5 |
| 2,052,186 | 8/1936 | Mapes | 222/5 X |
| 2,058,244 | 10/1936 | Mapes | 222/5 |
| 2,634,754 | 4/1953 | Rahn | 251/31 |
| 3,070,818 | 1/1963 | Fairchild | 441/93 |
| 3,633,596 | 1/1972 | Gerber | 137/68.1 |
| 3,938,704 | 2/1976 | Milgram | 222/5 |
| 4,463,929 | 8/1984 | Dantlgraber et al. | 251/44 |
| 4,500,014 | 2/1985 | Zimmerly | 222/5 |
| 4,635,754 | 1/1987 | Aschauer et al. | 441/93 X |

OTHER PUBLICATIONS

Air-Lock, Inc., Lift-Raft Valves Nos. 9864 and 9906.

*Primary Examiner*—Joseph J. Rolla
*Assistant Examiner*—Stephen Parker
*Attorney, Agent, or Firm*—Maurice M. Klee

[57] ABSTRACT

A valve mechanism for opening the seal on a high pressure gas cylinder, e.g., a cylinder having an internal pressure on the order of 6,000 psi, is provided. The valve includes a piston assembly which carries a cutter for puncturing the cylinder's seal. The initial puncture is performed manually. Thereafter, the escaping gas from the cylinder is used to force the piston towards the seal to complete the puncturing process.

15 Claims, 5 Drawing Sheets

VALVE FOR PUNCTURING AND RELEASING GAS FROM A PRESSURIZED CYLINDER

BACKGROUND OF THE INVENTION

This invention relates to valves for puncturing and releasing gas from pressurized cylinders.

Numerous configurations for valves of this type are known. U.S. Pat. Nos. 805,474, 1,782,020, 1,826,088, 2,028,651 2,634,754, 3,070,818, 3,633,596, 3,938,704 and 4,463,929 illustrate some of the designs which have been proposed.

Although many prior art valves work successfully with low pressure cylinders e.g., cylinder whose internal pressures are on the order of 800 pounds per square inch (psi), such valves are generally not adaptable for use with high pressure cylinders, e.g., cylinders whose internal pressures are on the order of 6,000 psi. Specifically, it takes more force to break the seal on a high pressure cylinder than it does on a low pressure cylinder. Accordingly, it has generally been found difficult to break these seals with existing low pressure puncturing mechanisms and, in particular, with manually-operated mechanisms, including manually-operated mechanisms employing cam and springs to aid the user in puncturing the seal.

Moreover, the breaking of the seal on a high pressure cylinder produces an exiting stream of high pressure gas. This escaping gas represents an additional force which the puncturing mechanism must overcome to open the cylinder. In general, it has been found difficult to generate enough inward force to quickly and reliably open the seal on high pressure cylinders in the presence of escaping gas with existing low pressure puncturing mechanisms and, in particular, manually-operated mechanisms.

High pressure cylinders filled with nitrogen or air and employing poppet type valves have been used to inflate life rafts. However, because of the problems discussed above, cylinders employing puncture type seals and, in particular, hermetically sealed cylinders, have not been used with these gases at high pressures. Rather, these types of seals have been limited to low pressure cylinders employing carbon dioxide as the primary inflation gas. As is recognized in the art, puncture type seals and, in particular, puncture type seals in which the cylinder is hermetically sealed, are preferred to poppet type seals because of the reduced chance of significant loss of pressure during storage.

The inflation of life rafts would benefit from the availability of a reliable valve for high pressure cylinders employing puncture type seals since this would mean that these cylinders could be used when nitrogen or air, instead of carbon dioxide, is to be the primary inflation gas. Although carbon dioxide is a suitable gas for inflating life rafts at normal temperatures, problems develop when either low or high temperatures are encountered, e.g., low temperatures on the order of −30° F. or high temperatures on the order of +150° F. Such temperatures can be encountered for life rafts used in aircraft, especially when the life raft is stored in the aircraft's wings.

At low temperatures, the liquid carbon dioxide in the cylinder vaporizes slowly resulting in a slow inflation process. Moreover, the expansion of the carbon dioxide vapor as it passes out of the cylinder into the life raft results in even lower temperatures which causes the carbon dioxide vapor to solidify into dry ice. The dry ice, in turn, can block the exit passages in the valve, thus further slowing the inflation process, and can accumulate on and thus damage the fabric making up the life raft. At high temperatures, on the other hand, the pressure in the cylinder can increase to levels characteristic of a high pressure cylinder thus bringing into play the problems, discussed above, which arise in puncturing high pressure cylinders.

In contrast, nitrogen and air do not exhibit temperature dependent problems over the −30° F. to +150° F. range, or, for that matter, even substantially beyond that range. Indeed, charges of nitrogen have been included in carbon dioxide cylinders to help propel liquid carbon dioxide out of the cylinder under low temperature conditions. However, to provide the same number of cubic feet of gas at one atmosphere pressure from a cylinder filled with nitrogen or air as are provided by a cylinder filled with liquid carbon dioxide, pressures on the order of 6,000 psi must be employed. To date, notwithstanding their superior properties in comparison to carbon dioxide, this need for higher pressures and the resulting need for a reliable valve capable of puncturing high pressure cylinders have prevented the use of puncture-type nitrogen or air cylinders in the inflation of life rafts.

SUMMARY OF THE INVENTION

In view of the foregoing state of the art, it is an object of the present invention to provide improved valve mechanisms for use with pressurized gas cylinders.

It is a specific object of the invention to provide valve mechanisms which can be used with high pressure gas cylinders. More particularly, it is an object of the invention to provide manually-operated valve mechanisms which are capable of quickly and reliably opening the seals on high pressure gas cylinders.

It is a further object of the invention to provide valve mechanisms which can be used high pressure gas cylinders employing puncture type seals and, in particular, to hermetically sealed high pressure cylinders.

It is an additional object of the invention to provide valve mechanisms which will independently vent (1) any pressure leakage from the cylinder, and (2) any gases trapped in the item, e.g., in the life raft, which is to be inflated.

With regard to specific applications, it is an object of the invention to provide valve mechanisms suitable for use in the inflation of life rafts, and, in particular, for use in the inflation of life rafts with nitrogen or air. Moreover, it is an object of the invention to provide all of the foregoing by means of valve mechanisms which have a minimum of moving parts, which are light, compact, and simple in design, and which can be readily and inexpensively produced.

To achieve the foregoing and other objects, the invention provides a valve mechanism for opening the seal on the mouth of a pressurized cylinder which comprises:

(A) a valve body which has a longitudinal axis;

(B) means for attaching the valve body to the cylindelr so that the longitudinal axis intersects the cylinder's mouth;

(C) a chamber within the valve body;

(D) a piston assembly journaled in the body for movement along the longitudinal axis, the piston assembly including:

(1) a piston which divides the chamber into two portions, one portion being towards the cylinder's mouth and the other portion being away from the mouth, the portion towards the mouth being (a) vented and (b) isolated from the mouth so that gas cannot pass from the mouth to this portion of the chamber; and (2) means which moves with the piston for opening the seal;

(E) means for conducting gas from the mouth of the cylinder to the portion of the chamber away from the mouth; and (F) means for moving the piston assembly along the longitudinal axis towards the mouth of the cylinder so as to open the cylinder's seal, the escaping gas from the cylinder's mouth being conducted to the portion of the chamber away from the mouth where it forces the piston towards the mouth, thus aiding the moving means in completing the opening process.

In certain preferred embodiments of the invention, the valve includes an exit conduit which is connected to the portion of the chamber towards the cylinder's mouth, i.e., the vented portion of the chamber, when the valve is not in use and which becomes connected to the portion of the chamber away from the cylinder's mouth as the valve is used so that the pressure of the gas exiting from the cylinder is continually applied to the piston assembly to hold that assembly in its fully operated position until all the gas has escaped from the cylinder.

In other preferred embodiments, the means for conducting gas from the cylinder's mouth to the portion of the chamber away from the cylinder's mouth is vented to the outside of the valve body when the valve is not in use so as to provide an escape path for the gas in the cylinder if the seal on the cylinder should rupture either accidently or as the result of a build up of excess pressure in the cylinder due to, for example, heating of the cylinder.

In still other preferred embodiments, the means for conducting gas from the cylinder's mouth to the portion of the chamber away from the cylinder's mouth comprises a conduit which passes through the piston. In connection with these embodiments, it is further preferred to use the leading edge of the conduit as the means for opening the seal and to vent the trailing portion of the conduit to provide the escape path for the gas in the cylinder in the case of a seal rupture when the valve is not in use.

The accompanying drawings, which are incorporated in and constitute part of the specification, illustrate the preferred embodiments of the invention, and together with the description, serve to explain the principles of the invention. As used in this specification and in the appended claims, the word "cylinder" is intended to generically encompass vessels and containers for holding pressurized gas of all sizes and shapes and not merely those which are cylindrically shaped.

DESCRIPTION OF THE PREFERRED EMBODIMENTS

Figure 1:
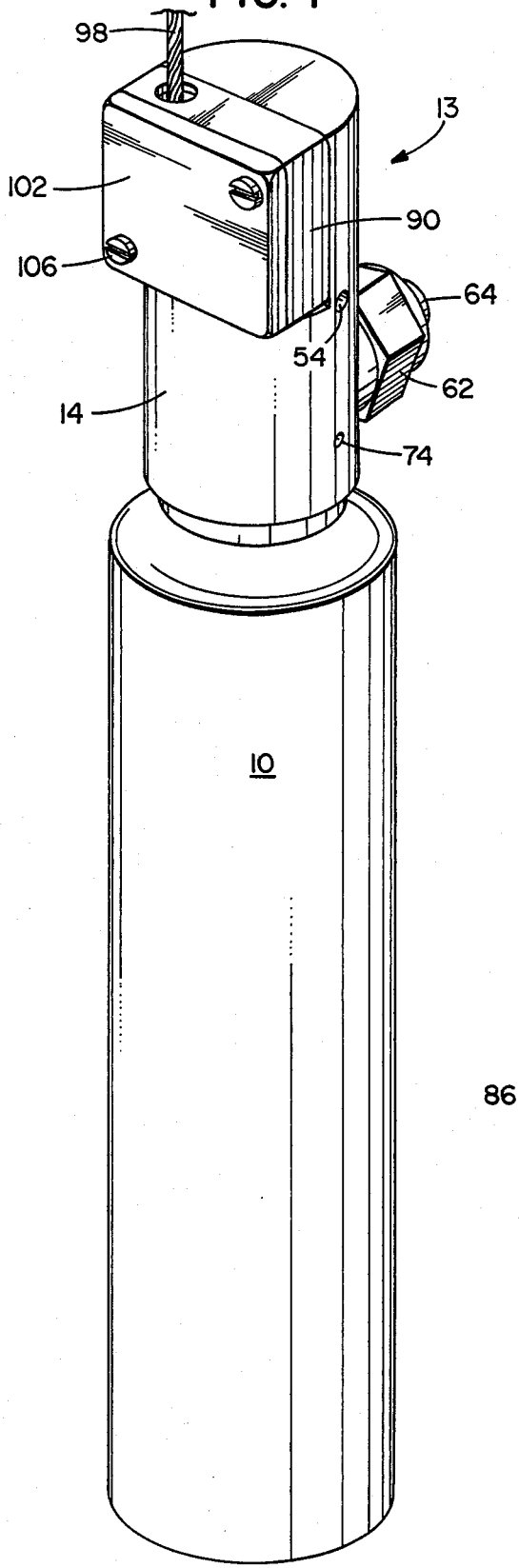
FIG. 1 is a perspective view of a gas cylinder to which has been attached a valve constructed in accordance with the present invention.
Figure 2:
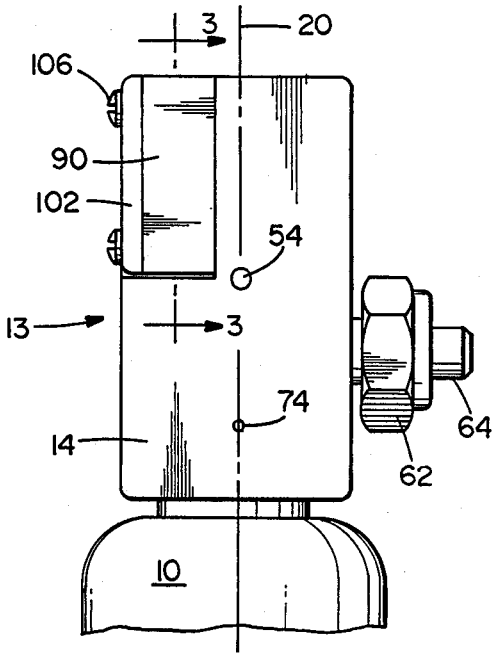
FIG. 2 is a side view showing the valve and the top portion of the cylinder of FIG. 1.
Figure 3:
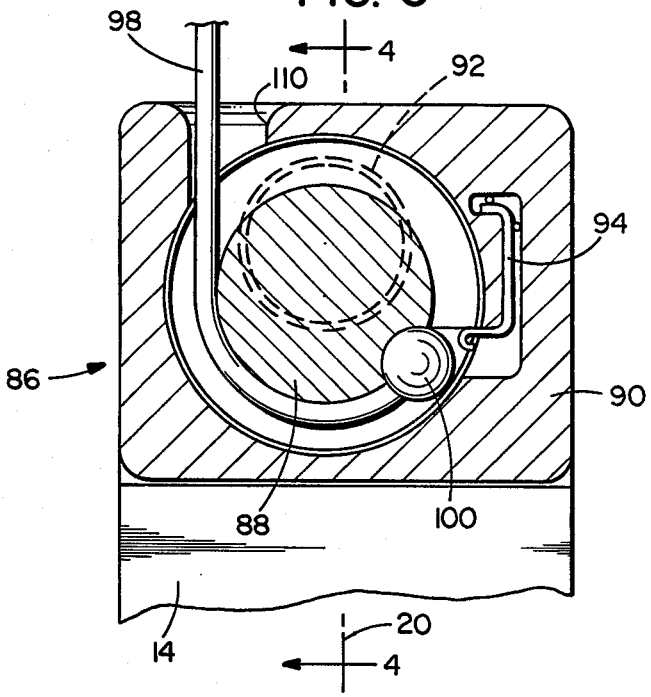
FIG. 3 is a cross-sectional view along lines 3—3 in FIG. 2 showing the actuation mechanism of the valve in its inactive/ready state.

With reference now to the drawings, wherein like reference characters designate like or corresponding parts throughout the several views, there is shown in FIG. 1 a perspective view of a pressurized cylinder 10 to which has been attached valve 13 constructed in accordance with the present invention.

Valve 13 is attached to cylinder 10 by means of thread 18 which mates with complementary thread 19 formed around the outside of the cylinder's mouth 16. When attached to the cylinder, the valve's longitudinal axis 20 intersects mouth 16, and, in particular, intersects seal 22 which is formed in the mouth and seals the cylinder closed.

Valve 13 includes body 14 within which are chamber 24 and piston assembly 26. Piston assembly 26 includes: (a) cutter 28 having an opening 25 and a sharp, leading edge 29 which is used to puncture seal 22, (b) piston 30 which rides in chamber 24, and (c) extension 32 which journals the piston assembly in body 14 along longitudinal axis 20. O-rings 44 and 46 are used to form seals between valve body 14 and piston 30 and extension 32, respectively.

Figure 5:
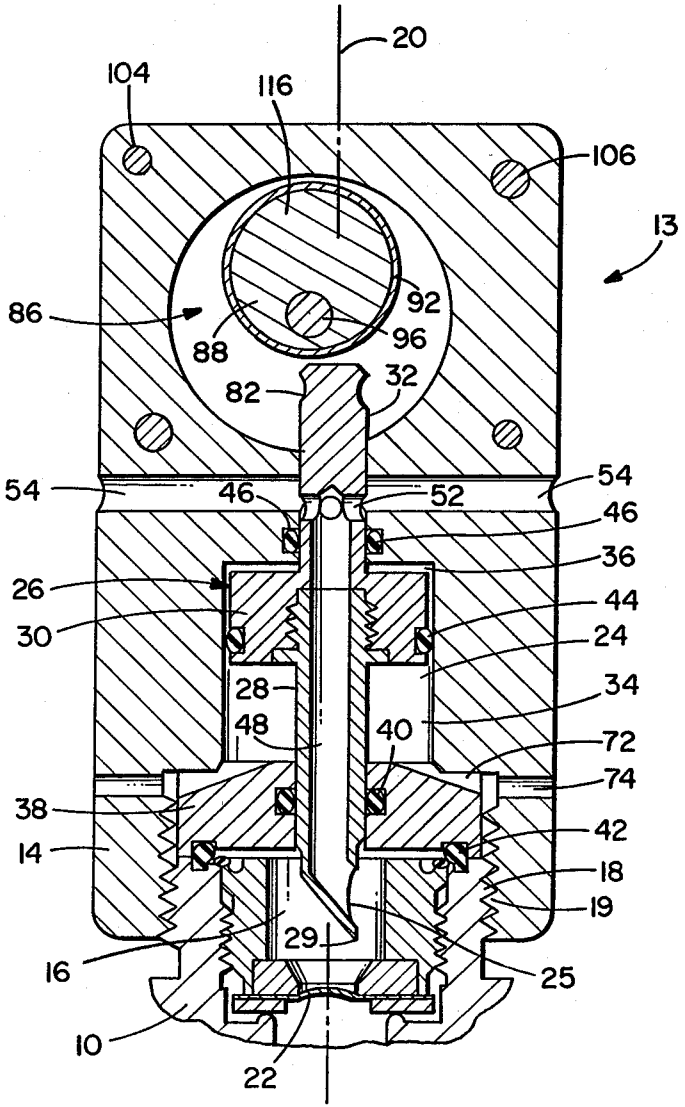
FIG. 5 is a cross-sectional view along lines 5—5 in FIG. 4 showing the valve in its inactive/ready state.

Formed within cutter 28, piston 30, and extension 32 is conduit 48 which conducts the exiting gas (indicated by arrows 50 in FIG. 6 and 8) from mouth 16 into the valve. The exiting gas leaves conduit 48 by means of crossed-ports 52 formed in the trailing portion of the conduit. When the valve is not in use, ports 52 are connected to vent passages 54 which pass through and out of valve body 14 (see FIG. 5). The conduit/port/vent pathway provides an escape route for the pressurized gases in cylinder 10 if the cylinder's seal 22 should unexpectedly rupture during storage or handling.

Connected to chamber 24 is exit conduit 56, attached to which by means of threads 60 is outlet assembly 58. This assembly includes threaded nut 62 for attaching the valve to a life raft or other device to which the pressurized gas in cylinder 10 is to be applied. Nut 62 is mounted on nut retainer 63 which is threaded into threads 60. As shown in the figures, diffuser 64 having exit ports 66 has been threaded into nut 62. Diffuser 64 allows the gas in cylinder 10 to safely leave valve 13 if the valve is accidently operated during shipping or handling. O-ring 68 is used to form a seal between outlet assembly 58 and valve body 14. During shipping, O-ring 70 is used to form a seal between diffuser 64 and the outlet assembly. During use, O-ring 70 provides a seal betwen the outlet assemby and, for example, the raft inlet.

Figure 7:
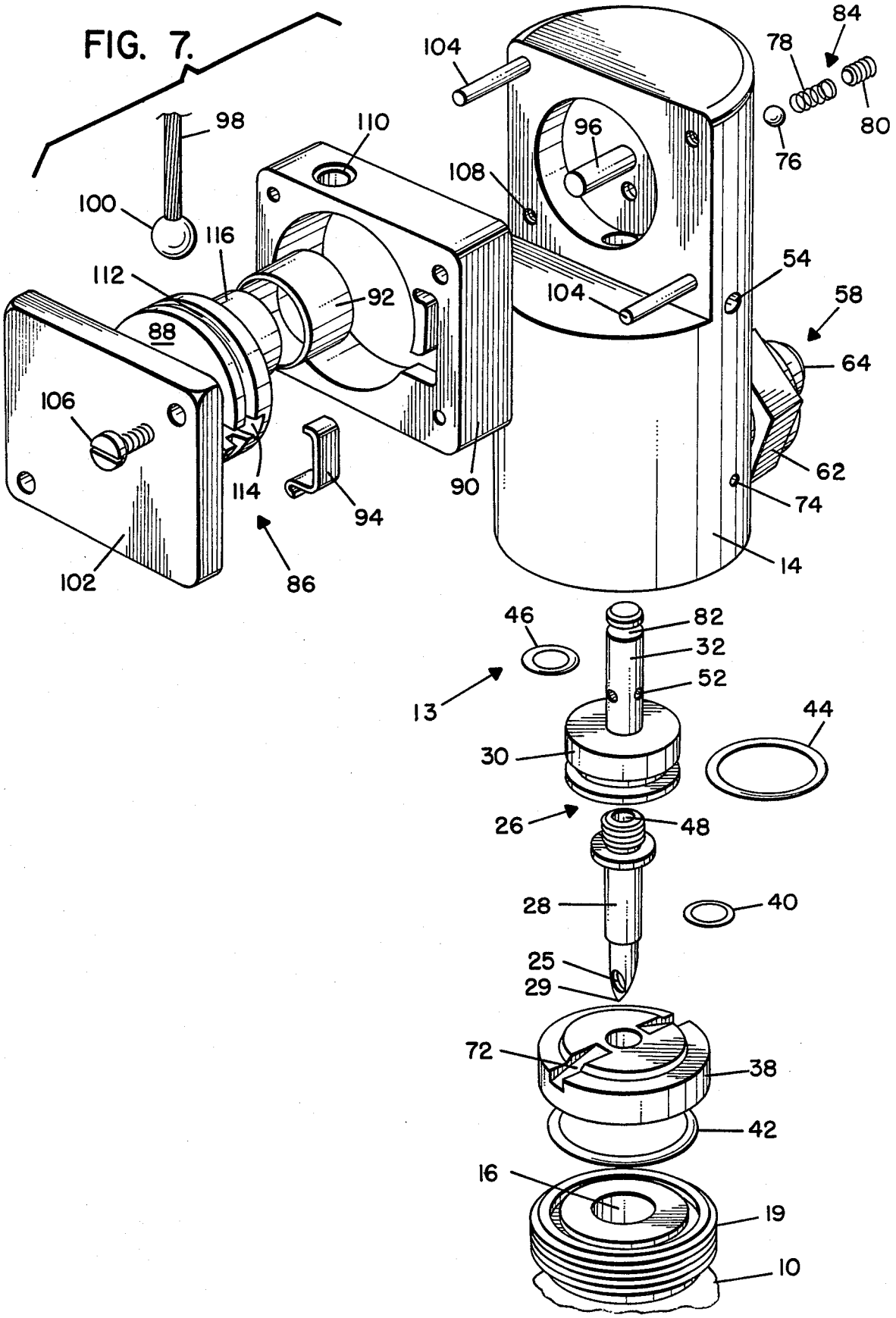
FIG. 7 is an exploded perspective view of the components of the valve.

Piston 30 divides chamber 24 into a portion 34 towards mouth 16 and a portion 36 away from mouth 16. Seal plate 38 forms the bottom of chamber 24. This plate and its associated O-rings 40 and 42 isolate portion 34 of chamber 24 form mouth 16 so that the exiting gases from cylinder 10 cannot reach this portion of the chamber. As can best be seen in FIGS. 5 and 7, the upper surface of seal plate 38 includes channels 72 which connect portion 34 of chamber 24 to vent passages 74 which pass through and out of valve body 14.

As discussed below, as the valve is used, piston 30 moves downward causing the size of portion 34 of chamber 24 to decrease to essentially zero volume and the size of portion 36 to increase until it comprises essentially the total volume of chamber 24 not occupied by the piston assembly (see FIGS. 4–6 and 8). Channels 72 in seal plate 38 and vent passages 74 allow the air in portion 34 to exit from the valve during this downward movement of the piston.

Figure 4:
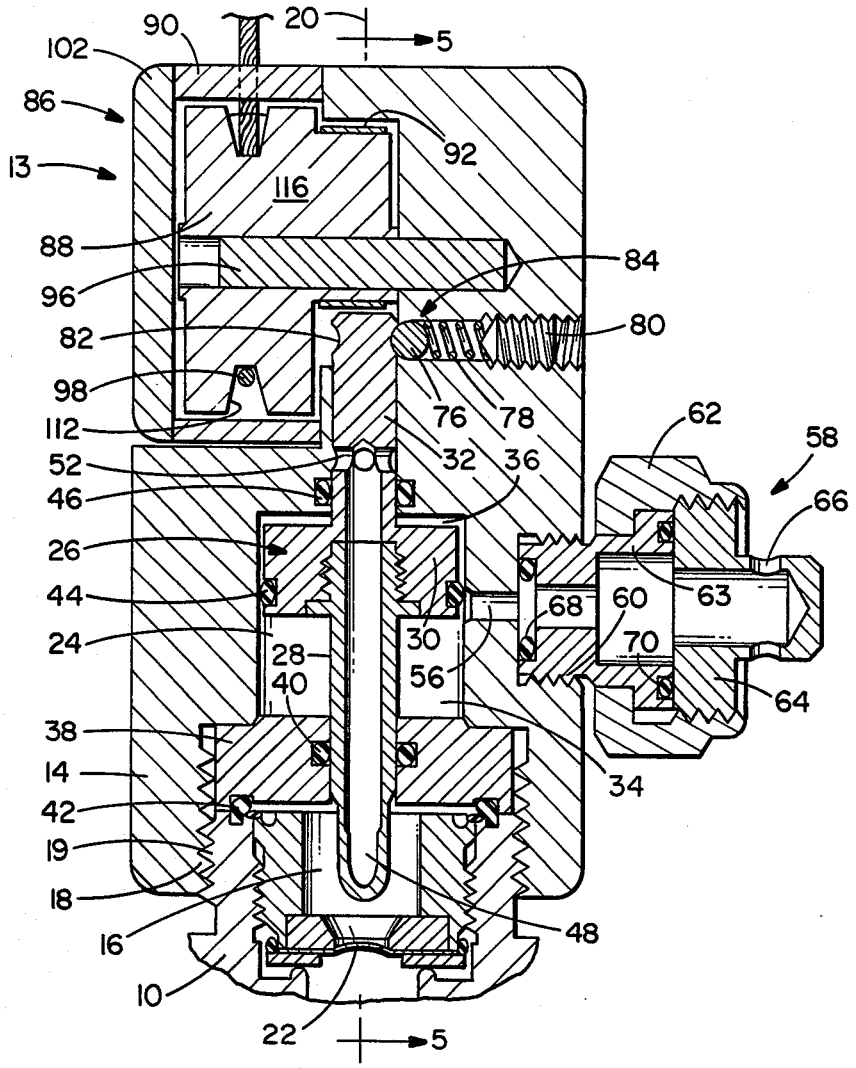
FIG. 4 is a cross-sectional view along lines 4—4 in FIG. 3 showing the valve in its inactive/ready state.
Figure 6:
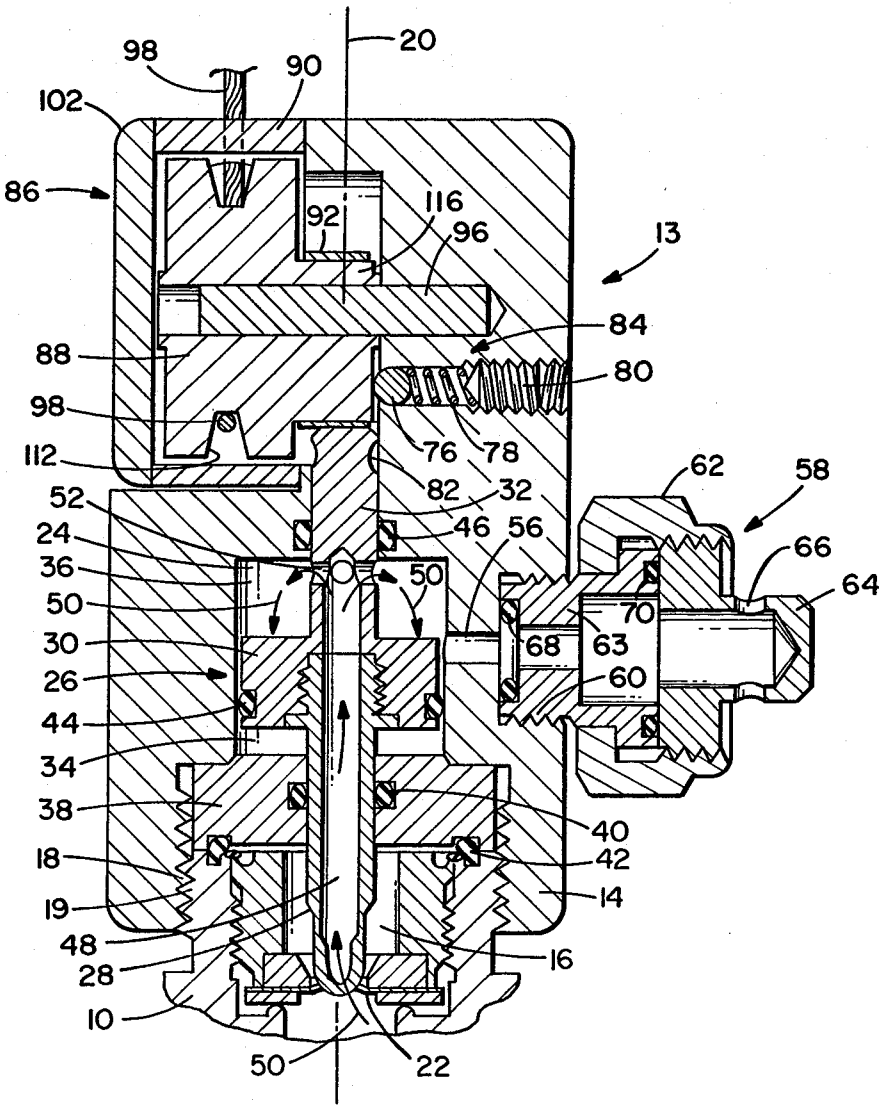
FIG. 6 is a cross-sectional view along lines 4—4 in FIG. 3 showing the valve after initial opening of the seal on the cylinder.
Figure 8:
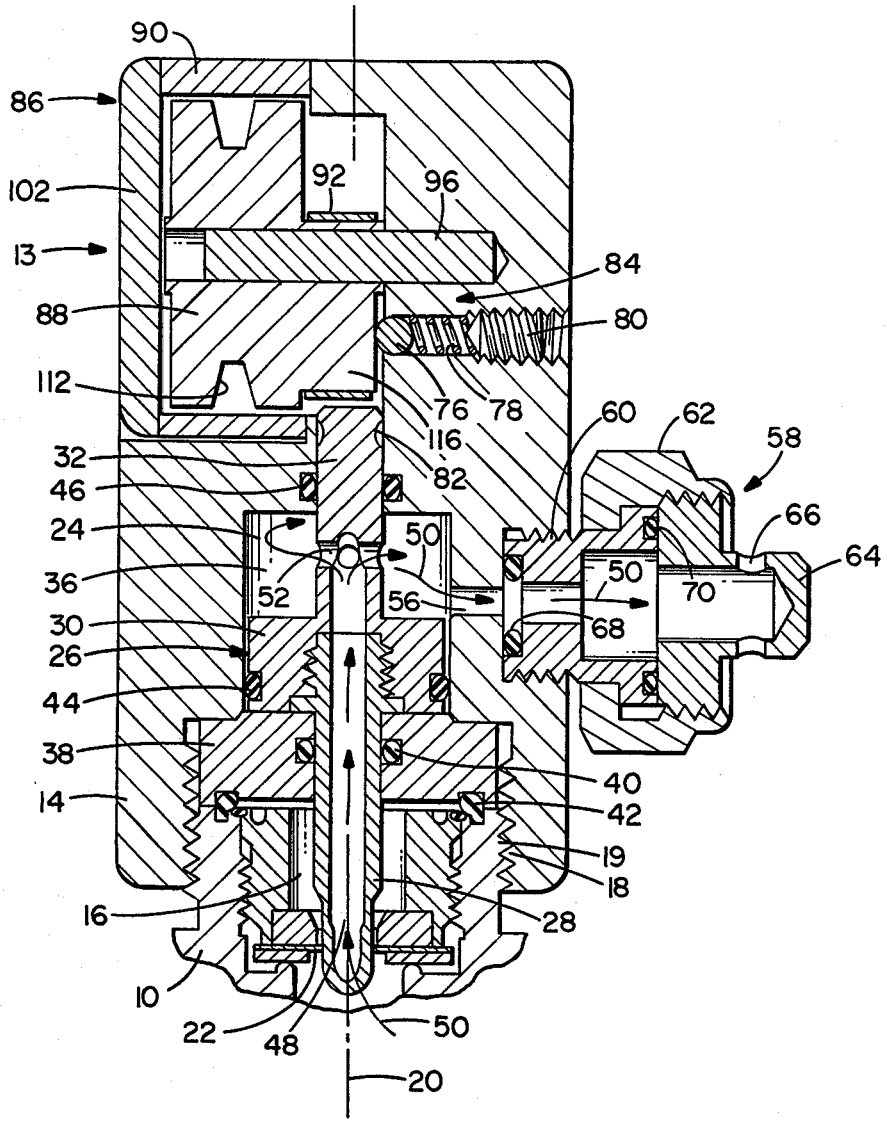
FIG. 8 is a cross-sectional view along lines 4—4 in FIG. 3 showing the valve in its fully activated state.

As can be seen by comparing FIGS. 4, 6 and 8, exit conduit 56 is connected to portion 34 of chamber 24 when the valve is not in use and become connected to portion 36 as the valve is used. The connection to portion 34 when the valve is not in use results in the exit conduit, and thus whatever device is connected to the exit conduit, being vented to atmospheric pressure by means of channels 72 and vent passages 74. Such venting is or particular value in connection with the inflation of life rafts since it provides an exit path for any air which may be present in the life raft. For life rafts carried in aircraft, an exit path for such residual air is necessary to avoid partial inflation of the life raft as the altitude of the aircraft increases.

To hold piston assembly 26 in its inactive/ready position, valve 13 includes detent mechanism 84. This mechanism includes ball 76, spring 78, and set screw 80. Ball 76 engages groove 82 formed in the upper portion of extension 32 and thus holds the piston assembly in its uppermost position with cutter 28 out of engagement with seal 22.

Valve 13 is activated by means of actuator assembly 86. This assembly comprises actuator 88, actuator housing 90, bushing 92, detent clip 94, pin 96, lanyard 98, and lanyard ball 100. The actuator assembly is held in place by means of cover 102 which includes pins 104 which pass through actuator housing 90 into valve body 14. the cover, in turn, is held in place by screws 106 which pass through the actuator housing and engage threaded holes 108 in valve body 14.

Actuator assembly 86 works as follows. Lanyard 98 and lanyard ball 100 pass through opening 110 in actuator housing 9 and are wrapped around actuator 88 with the lanyard being received in groove 112 and the ball in recess 114. In the assembled valve, the actuator rides in actuator housing 90 and is journaled on pin 96. Bushing 92 surrounds eccentric portion 116 of the actuator and serves to reduce friction between the actuator and the upper surface of extension 32 of piston assembly 26. Detent clip 94 engages the edge of recess 114 and holds the actuator assembly in its inactive/ready condition.

Pulling on lanyard 98 causes actuator 88 to rotate approximately 180°. Eccentric portion 116 of the actuator functions as a cam surface during this rotation and causes piston assembly 26 to move downward from its inactive/ready position to puncture seal 22. Lanyard 98 and ball 100 pull free of the valve through opening 110 once actuation has been completed.

Valve 13 operates in response to the actuation of actuator assembly 86 as follows. The initial rotation of actuator 88 causes piston assembly 26 to move downward thus breaking the connection between crossed-ports 52 and vents 54 and forming a connection between those ports and portion 36 of chamber 24. This downward movement also causes exit conduit 56 to become connected to portion 36, rather than portion 34, of chamber 24. As this downward movement takes place, the air in portion 34 of chamber 24 leaves valve 13 by means of channels 72 in seal plate 38 and vent passages 74.

Once ports 52 and exit conduit 56 are both connected to portion 36 of chamber 24, puncturing of seal 22 begins. Leading edge 29 of cutter 28 causes the initial puncture. The gas escaping from the initial puncture passes into the cutter's opening 25, thorugh conduit 48, and out of ports 52, where it fills portion 36 of chamber 24 and causes piston 30 to move downward thus forcing the cutter's leading edge completely through the cylinder's seal to complete the puncturing process (see FIGS. 6 and 8).

Thereafter, gas flows from the cylinder through conduit 48, portion 36 of chamber 24, and out of the valve through exit conduit 56 (see FIG. 8). This continual flow keeps piston assembly 26 in its full downward position. Accordingly, exit conduit 56 and crossed-ports 52 remain in portion 36 of chamber 24 thus assuring that gas does not escape through vent passages 54 or 74. It should be noted that once inflation has been completed, the final pressure in the inflated device/cylinder/valve combination will also act to keep piston assembly 26 in it fully operated position.

In practice, the valve of the present invention has been found to reliably puncture cylinders containing nitrogen gas at pressures on the order of 6,000 psi. The nitrogen gas has, in turn, been used to sucessfully inflate life rafts.

The valve can be constructed from conventional materials normally used in the construction of valve mechanisms. For example, valve body 14, seal plate 38, outlet assembly 58, piston 30 and its extension 32 can be made out of aluminum, cutter 28 and pins 96 and 104 can be made out of stainless steel, bushing 92 can be made of brass, O-rings 40, 42, 44, 46, 68, and 70 can be made of silicone, Buna N, or other elastomers depending on the particular temperature at which the valve is to be used, and actuator 88, actuator housing 90 and cover 102 can be made of plastic materials, such as, Delrin, ABS, or polycarbonate based plastics. Other materials, of course, can be used if desired.

Although specific embodiments of the invention have been described and illustrated, it is to be understood that modifications can be made without departing from the invention's spirit and scope. For example, although the valve is of particular value when used with high pressure cylinders, it can also be used with low pressure cylinders, such as, carbon dioxide cylidners. Also, although illustrated herein with reference to a cylinder which has been sealed with a puncturable disc, the invention can also be used with poppet type seals in which case the leading edge of the conduit would open the seal by contacting the moving the stem of the poppet seal. Similarly, although of particular benefit where manual actuation is to be employed, other forms of actuation, including, electrical, spring, and detonation actuation, can be used if desired.

What is claimed is:

1. Apparatus for opening the seal on the mouth of a cylinder which contains pressurized gas comprising:

(a) a body having an axis and including a chamber;

(b) means for attaching the body to the cylinder in the region of the mouth so that the axis intersects the mouth;

(c) a piston assembly journaled in the body for movement along the axis, the piston assembly including:
(i) a piston which divides the chamber into a portion away from the mouth and a portion towards the mouth, the portion towards the mouth being isolated from the mouth; and
(ii) means which moves with the piston for opening the seal;
(d) means for conducting gas from the mouth to the portion of the chamber away form the mouth
(e) means for venting the portion of the chamber towards the mouth; and
(f) means for moving the piston assembly along the axis towards the mouth for a limited portion of the total stroke of the piston through the chamber so that the means for opening opens the seal by producing an initial puncture of the seal, the gas escaping from the mouth through the puncutre being conducted to the portion of the chamber away from the mouth by the conducting means where it moves the piston assembly towards the mouth for the remainder of the total stroke of the piston to produce a complete puncture of the seal.

2. The apparatus of claim 1 further including an exit conduit which is connected to the portion of the chamber away from the mouth when the piston assembly has been moved towards and has opened the seal.

3. The apparatus of claim 2 wherein:
(a) the piston assembly has a first position in which the opening means is out of engagement with the seal; and
(b) the exit conduit is connected to the portion of the chamber towards the mouth when the piston assembly is in its first position.

4. The apparatus of claim 3 further including detent means for holding the piston assembly in its first position.

5. The apparatus of claim 1 wherein:
(a) the piston assembly has a first position in which the opening means is out of engagement with the seal; and
(b) the means for conducting gas from the region of the mouth of the cylinder is vented when the piston assembly is in its first position.

6. The apparatus of claim 1 wherein the means for conducting gas from the region of the mouth to the portion of the chamber away from the mouth is a conduit which passes through the piston assembly.

7. The apparatus of claim 6 wherein the opening means comprises the leading edge of the conduit.

8. The apparatus of claim 7 wherein:
(a) the piston assembly has a first position in which the leading edge of the conduit is out of engagement with the seal; and
(b) the trailing portion of the conduit is vented when the piston assembly is in its first position.

9. The apparatus of claim 1 wherein the moving means is manually-operated.

10. The apparatus of claim 9 wherein the moving means comprises a lanyard-driven cam surface.

11. The apparatus of claim 1 wherein the pressurized gas is nitrogen or air.

12. The appratus of claim 1 wherein:
(a) the piston assembly has a first position in which the opening means is out of engagement with the seal;
(b) the apparatus further includes an exit conduit which is connected to the portion of the chamber towards the mouth when the piston assembly is in its first position and is connected to the portion of the chamber away from the mouth when the piston assembly has been moved out of its first position and has opened the seal;
(c) the means for conducting gas from the region of the mouth to the portion of the chamber away from the mouth is a conduit which passes through the piston assembly;
(d) the opening means comprises the leading edge of the conduit; and
(e) the trailing portion of the conduit is vented when the piston assembly is in its first position.

13. The apparatus of claim 12 wherein the moving means are manually operated.

14. The apparatus of claim 13 wherein the moving means comprises a manually-operated, lanyard-driven cam surface.

15. The apparatus of claim 12 wherein the pressurized gas is nitrogen or air.

* * * * *

UNITED STATES PATENT AND TRADEMARK OFFICE

CERTIFICATE OF CORRECTION

PATENT NO. : 4,805,802

DATED : February 21, 1989

INVENTOR(S) : Robert R. MacKendrick and John J. Mckeon

It is certified that error appears in the above-identified patent and that said Letters Patent is hereby corrected as shown below:

Column 1/line 14 "e.g., cylinder whose" should read "e.g., cylinders whose"

Column 2/line 39 "be used high" should read "be used with high"

Column 5/line 42 "the cover" should read "The cover"

Column 5/line 47 "housing 9 and" should read "housing 90 and"

Column 6/line 11 "thorugh conduit" should read "through conduit"

Column 7/line 10 "the mouth" should read "the mouth;"

Column 7/line 18 "puncutre" should read "puncture"

Signed and Sealed this

Twenty-eighth Day of April, 1992

*Attest:*

HARRY F. MANBECK, JR.

*Attesting Officer*

*Commissioner of Patents and Trademarks*